United States Patent [19]

Coldren et al.

[11] 4,175,811

[45] Nov. 27, 1979

[54] CONNECTOR HAVING SNUBBER NETWORK FOR TRIAC

[75] Inventors: Daniel R. Coldren, Enola; Paul R. Krider, Camp Hill; Benjamin C. Williams, Harrisburg, all of Pa.

[73] Assignee: AMP Incorporated, Harrisburg, Pa.

[21] Appl. No.: 881,468

[22] Filed: Feb. 27, 1978

[51] Int. Cl.[2] ..... H01R 31/06

[52] U.S. Cl. ..... 339/19; 339/191 M; 339/256 SP

[58] Field of Search ..... 339/17 CF, 19, 191 R, 339/191 A, 191 M, 191 S, 192 R, 193 R, 222, 256 SP, 258 S

[56] References Cited

U.S. PATENT DOCUMENTS

| | | | |
|---|---|---|---|
| 3,448,345 | 6/1969 | Koehler et al. | 339/17 CF |
| 3,546,664 | 12/1970 | DeBolt et al. | 339/256 SP |
| 4,080,026 | 3/1978 | Gianni | 339/17 CF |

*Primary Examiner*—Neil Abrams

*Attorney, Agent, or Firm*—Frederick W. Raring

[57] ABSTRACT

Electrical connector for connecting three wires to three terminal tabs and for connecting a network across two of the tabs comprises a housing having three terminal-receiving cavities extending therethrough in surrounding relationship to a network module cavity. Two of the terminals in the terminal-receiving cavities each have a main receptacle, which mates with one of the terminal tabs, and secondary receptacle which receives a terminal tab extending from the network module.

5 Claims, 6 Drawing Figures

Fig. 2
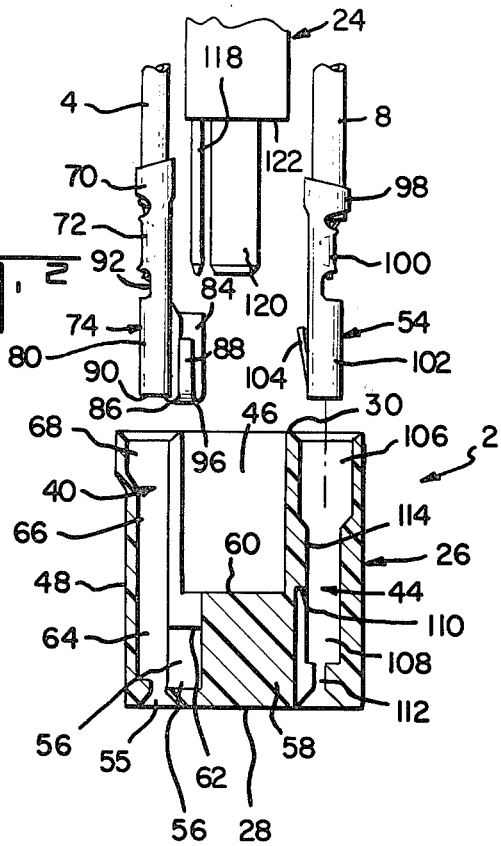
Fig. 3
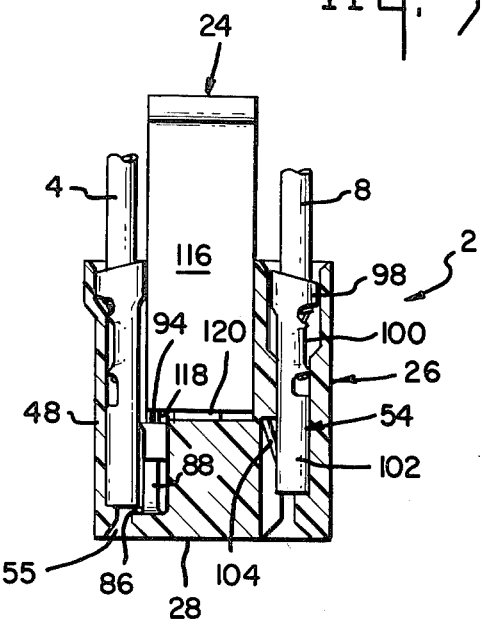
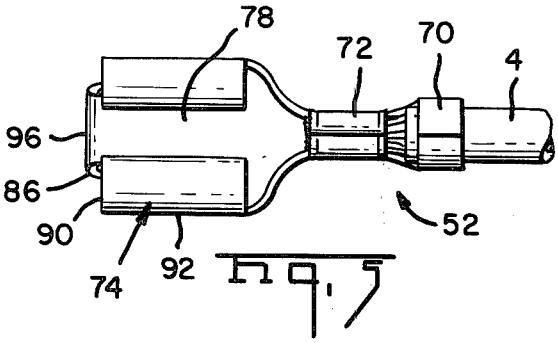
Fig. 5
Fig. 4
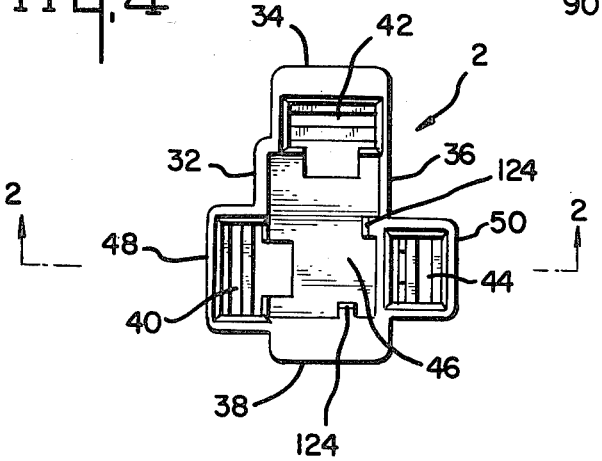
Fig. 6
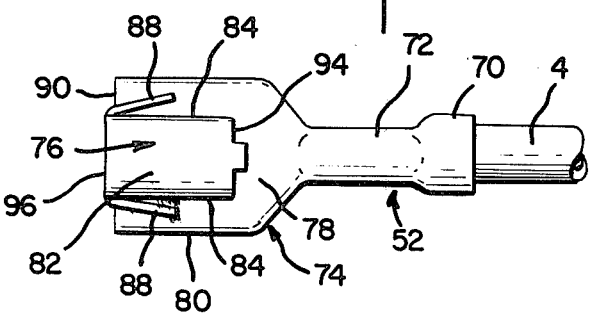

CONNECTOR HAVING SNUBBER NETWORK FOR TRIAC

BACKGROUND OF THE INVENTION

This invention relates to an electrical connector for connecting a plurality of wires to a plurality of terminal tabs and for connecting a network across two of the terminal tabs. The embodiment of the invention disclosed herein is particularly intended for connecting three wires to three terminal tabs extending from a triac and for connecting a snubber network across two of the terminal tabs however, the invention can be used under many other circumstances for similar types of connections.

Semi-conductor devices, such as triacs, are commonly packaged or mounted in standard arrangements with terminal tabs extending from the package at predetermined locations so that standard connectors can be provided to mate with the terminal tabs of the triac. Under many circumstances, the wires which extend to the triac are simply connected directly to the terminal tabs but under some circumstances, it is required that a snubber network be connected across two of the terminal tabs of the triac. A snubber network comprises capacitors and a resistor in series and serves to reduce the rate of change of voltage across the triac. The instant invention is directed to the achievement of a connector which has provision for connecting the snubber network across two of the tabs of the triac when required.

The invention comprises an insulating housing having three terminals mounted therein which are positioned such that they can be mated with the terminal tabs of the triac. The terminals are located in surrounding relationship to a module which is contained in the housing and which has two terminal tabs extending therefrom. When the module is inserted into a module-receiving cavity in the housing, the module tabs are received in secondary receptacles which are integral with two of the terminals in the housing.

It is accordingly an object of the invention to provide an improved connector for connecting wires to terminal tabs extending from a packaged solid state device such as a triac. A further object is to provide a connector having provision for connecting an auxiliary network across two of the terminals of the solid state device.

These and other objects of the invention are achieved in a preferred embodiment thereof, which is briefly described in the foregoing Abstract, which is described in detail below, and which is shown in the accompanying drawing in which:

FIG. 2 is a cross-sectional view taken along the lines 2—2 of FIG. 1 with the terminals exploded from the connector housing.

FIG. 3 is a view similar to FIG. 2 but showing terminals in their inserted positions in the housing.

FIG. 4 is a top plan view of the housing.

FIG. 5 is a top plan view of a terminal forming part of the invention.

FIG. 6 is a view of the underside of the terminal of FIG. 5.

Figure 1:
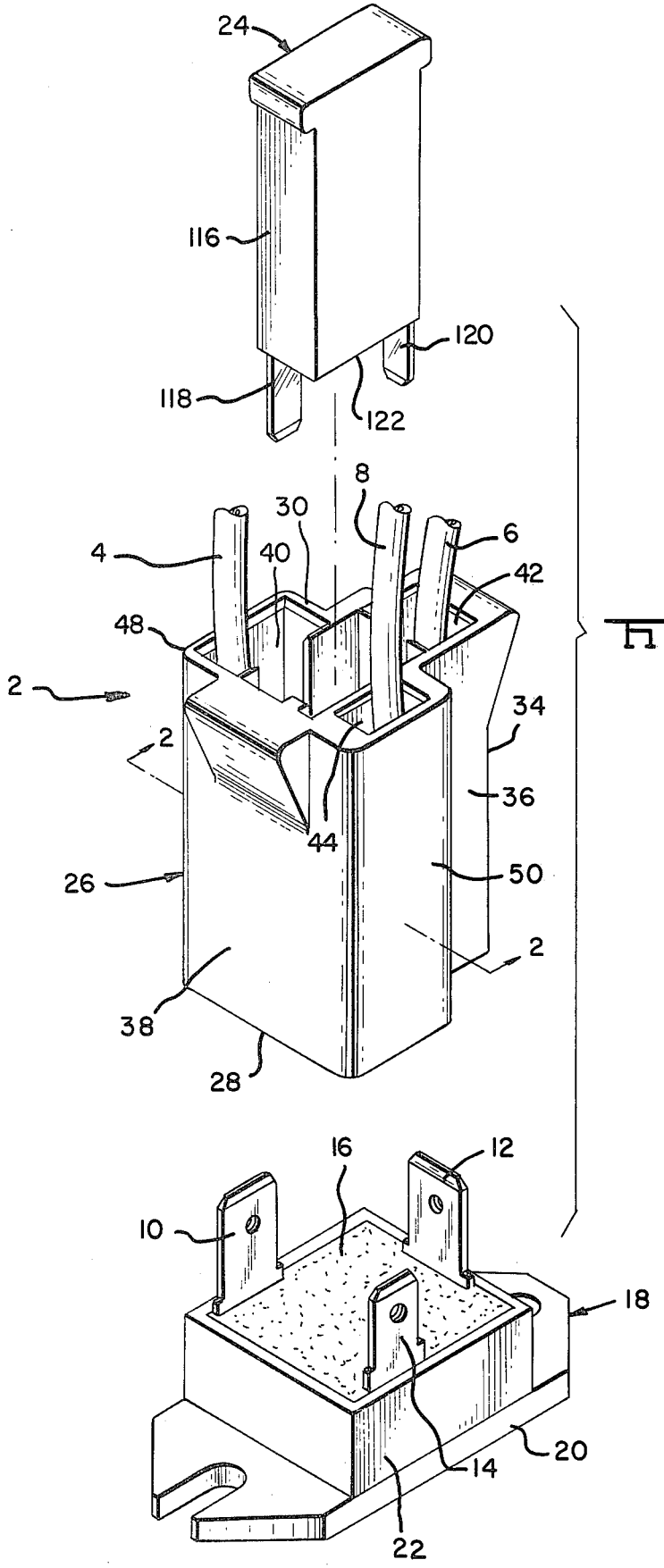
FIG. 1 is a perspective exploded view showing a connector in accordance with the invention, a triac, and a module containing an auxiliary network.

Referring first to FIG. 1, connector 2 in accordance with the invention serves to connect first, second and third wires 4, 6, 8 respectively to first, second and third terminal tabs 10, 12, 14 which extend from the upper surface 16 of a triac, or the like, 18. The triac has a metallic base 20 which serves as a heat sink and a body portion 22 which contains the chip and the electrical connections to the terminal tabs 10, 12, 14. The housing 2 removably receives a snubber module 24 containing a snubber network which is connected across the first and second terminal tabs 10, 12 when the connector assembly is mated with the terminal tabs of the triac.

The connector 2 comprises a molded body 26 of suitable insulating material, such as a filled nylon, having a mating face 28, a wire receiving face 30 and side surfaces 32, 34, 36 and 38.

First, second and third terminal-receiving cavities 40, 42 and 44 extend through the housing body from the wire receiving face 30 to the mating face 28. These cavities are dimensioned to receive terminals which have receptacle portions which in turn are dimensioned to be mated with the terminal tabs 10, 12 and 14. As shown in FIG. 4, the first and second cavities 40, 42 are identical to each other and are unlike the third cavity 44. The cavities 40, 42 are dimensioned to receive contact terminals of the type shown at 52 which have two receptacle portions. The third cavity 44 receives a conventional quick disconnect type terminal of the type shown at 54. The three terminal-receiving cavities surround a centrally located module-receiving cavity 46 which extends inwardly from the wire receiving face 30 and which has an inner end 60 which is spaced from the mating face 28 of the housing. The housing has projections 48, 50 on the sides 32, 36 which contain portions of the first and third cavities 40, 44 as was shown in FIG. 4, while the cavity 42 is adjacent to the side surface 34 of the housing.

Each of the first and second cavities 40, 42 has a constricted tab-receiving entrance 55 at the mating face 28 which opens into enlarged cavity portions 56, 64. The portion 56 extends inwardly of the central section 58 of the body beyond the limits of the module receiving cavity 46 and downwardly facing shoulders 62 are provided at the inner end 60 of cavity 46 for cooperation with retention lances 88 of the terminals 52 as will be described below. An intermediate cavity section 66 extends upwardly from the cavity section 64 and an enlarged upper portion 68 is provided adjacent to the wire receiving face 30 for the accommodation of the insulation crimp portion of the terminal as shown in FIG. 3. Each of the cavities 40, 42 communicates with the module-receiving cavity 46 as shown in FIG. 4. This feature permits insertion of the terminals 52 into the cavities 40, 42 as illustrated in FIGS. 2 and 3.

Each of the terminals 52 which are received in the first and second cavities 40, 42 has insulation and wire crimp portions 70, 72 which are crimped onto the insulation and the conductive core of a wire. A main receptacle 74 extends downwardly, as viewed in the drawing, from the wire crimp 72 and a secondary, somewhat more narrow, receptacle 76 is connected to the main receptacle at the lower free end 90 of the main receptacle. The main receptacle comprises a web 78 and sidewalls which extend from the side portions of the web and which are reversely curled towards each other and towards the surface of the web. The secondary receptacle 76 also has a web 82 and curled sidewalls as shown at 84. The lower end 96 of the secondary receptacle is connected to the lower tab receiving end 90 of the main receptacle 74 by a connecting strap 86 which extends from the web 82 to the web 78 and which serves to close off the lower end 96 of the secondary receptacle. Retention lances 88 extend obliquely upwardly from this strap member and are dimensioned to be received against the shoulders 62. It will be noted that the tab receiving end 94 of the secondary receptacle 76 is adjacent to the end 92 of the main receptacle and that, as previously noted, the secondary receptacle is somewhat smaller than the main receptacle.

The terminal 54 which is received in the third cavity 44 is of the conventional quick disconnect type having an insulation crimp 98, a wire crimp 100 and a receptacle portion 102, which is essentially similar to the receptacle portion 74 of the terminal 52. Terminal 54 has a lance 104 extending from its web portion which cooperates with a downwardly facing shoulder in the third cavity 44 as shown in FIG. 3.

The cavity 44 is separated from the module receiving cavity 46 by an internal wall 114. This cavity has an enlarged upper portion 106, a relatively narrower intermediate portion 108 which receives the receptacle 102, and a constricted lower portion 112 adjacent to the mating face 28 of the housing and which is dimensioned to receive the third terminal tab 14.

As shown in FIGS. 2 and 3, the lower ends of the terminals 52 are relatively closer to the mating face 28 of the housing than is the lower receiving end of the terminal 54 which is disposed in the third cavity 44. The cavity 44 has upwardly facing shoulder, against which the end of the terminal 54 rests and this shoulder is spaced from the face 28 by a greater distance than the shoulder against which the end of the terminal 52 is supported. This arrangement ensures that the first and second wires 4, 6 will be connected to the tabs 10, 12 before the terminal 54 is connected to the third terminal tab 14.

The snubber module 24 may be of suitable insulating material and the snubber network contained in the module is connected to first and second module tabs 118, 120 which extend downwardly from the lower face 122 of the body 116 of the module. Suitable ribs as shown at 124 are provided on the sidewalls of the module receiving cavity 46 to ensure that when the module is inserted into the cavity 46, the first and second module tabs 118, 120 will enter the secondary receptacles 76 of the previously inserted first and second terminals in the cavities 40, 42.

It will be apparent from the foregoing that the connector shown in FIG. 2 is assembled by simply inserting the terminals 52, 54 into the appropriate terminal receiving cavities and thereafter inserting the module 24 into the module receiving cavity 46. When the connector is mated with the triac, the wires 4, 6, 8 will be connected to the tabs 10, 12, 14, and the snubber network will then be connected across the terminals 10, 12.

What is claimed is:

1. An electrical connector for connecting first, second, and third wires to first, second, and third main terminal tabs respectively and for connecting a network between said first and second main tabs, said main tabs extending normally from a surface of a triac or the like, said connector comprising:

an insulating housing having a mating face and a wire-receiving face, first, second, and third terminal-receiving cavities extending through said housing from said wire receiving face to said mating face, first, second, and third terminals in said first, second, and third cavities, said terminals being proximate to said mating face, and being crimped onto said first, second, and third wires, said wires extending from said wire receiving face, each of said terminals having a main receptacle at said mating face which is mateable with one of said main tabs, each of said first and second terminals only having a secondary receptacle integral therewith, said secondary receptacles being parallel to and beside, their associated main receptacles, a module-receiving cavity extending into said housing from said wire-receiving face, said module-receiving cavity communicating with said first and second terminal-receiving cavities, a snubber module in said module-receiving cavity, said snubber module having first and second network terminal tabs extending therefrom, said network terminal tabs being mated with said first and second secondary receptacles whereby, upon movement of said mating face against said surface of said triac, said first, second, and third wires are connected to said first, second, and third main terminal tabs, and circuitry contained in said snubber module is connected across said first and second main terminal tabs.

2. An electrical connector as set forth in claim 1, said first, second and third main terminal tabs being located around the periphery of said surface of said triac, said terminal-receiving cavities being located around the periphery of said housing and in surrounding relationship to said module receiving cavity.

3. An electrical connector as set forth in claim 2, said main receptacles of each of said first and second terminals having a tab receiving end and a rearward end, said tab receiving ends being adjacent to said mating face, each of said secondary receptacles having a tab receiving end and a rearward end, said rearward ends of said secondary receptacles being adjacent to said mating face and said tab receiving ends of said secondary receptacles being spaced from said mating face.

4. An electrical connector as set forth in claim 3, each of said secondary receptacles being connected to its associated main receptacle by strap means extending from the rearward end of the secondary receptacle to the tab receiving end of the main receptacle.

5. An electrical connector for connecting first, second, and third wires to first, second, and third main terminal tabs respectively and for connecting a network between said first and second main terminal tabs, said main tabs extending from a surface of a triac or the like and being in surrounding relationship to a central axis, said connector comprising:

an insulating housing having a mating face and a wire-receiving face, first, second, and third terminal-receiving cavities extending through said housing from said wire-receiving face to said mating face, said terminal-receiving cavities being located around the periphery of said housing at locations corresponding to the locations of said main terminal tabs, a centrally located module-receiving cavity extending inwardly from said wire-receiving face, said module-receiving cavity communicating with said first and second terminal-receiving cavities, first, second, and third terminals in said first, second and third terminal-receiving cavities, each of said terminals having a main receptacle which is dimensioned to be mated with one of said first, second, and third main terminal tabs, said first, second, and third wires being secured to said first, second, and third terminals and extending from wire-receiving face, said first and second terminals only having secondary receptacles integral therewith, said secondary terminals being adjacent to said module receiving cavity, a network module in said module-receiving cavity, said network module having first and second network terminal tabs extending therefrom, said first and second network tabs being mated with said secondary receptacles whereby, upon mating said main terminal tabs with said main receptacles, said first, second and third wires are connected to said first, second and third main terminal tabs, and said network module is connected across said first and second main terminal tabs.

* * * * *